US009022697B2

(12) United States Patent
Ericsson et al.

(10) Patent No.: US 9,022,697 B2
(45) Date of Patent: May 5, 2015

(54) METHOD, SYSTEM AND ROCK DRILLING APPARATUS FOR INSTALLING A PIPE IN DRILLED HOLES IN ROCK DRILLING

(75) Inventors: Patrik Ericsson, Lindesberg (SE); Dan Jonsson, Sköllersta (SE); Magnus Olsson, Hallsberg (SE)

(73) Assignee: Atlas Copco Rock Drills AB, Orebro (SE)

( * ) Notice: Subject to any disclaimer, the term of this patent is extended or adjusted under 35 U.S.C. 154(b) by 77 days.

(21) Appl. No.: 13/261,634

(22) PCT Filed: Nov. 17, 2011

(86) PCT No.: PCT/SE2011/051384

§ 371 (c)(1),
(2), (4) Date: Apr. 10, 2013

(87) PCT Pub. No.: WO2012/067579

PCT Pub. Date: May 24, 2012

(65) Prior Publication Data

US 2013/0216312 A1 Aug. 22, 2013

(30) Foreign Application Priority Data

Nov. 17, 2010 (SE) ..... 1051208

(51) Int. Cl.

| | |
|---|---|
| ***E21D 20/00*** | (2006.01) |
| ***E21B 7/20*** | (2006.01) |
| ***E21B 7/02*** | (2006.01) |
| ***E21B 19/14*** | (2006.01) |
| ***E21B 3/02*** | (2006.01) |

(52) U.S. Cl.

CPC ..... *E21B 7/20* (2013.01); *E21D 20/006* (2013.01); *E21B 7/02* (2013.01); *E21B 19/146* (2013.01); *E21B 3/02* (2013.01)

(58) Field of Classification Search

CPC ..... E21D 20/006; E21D 20/003
USPC ..... 405/259.1, 288, 302.1
See application file for complete search history.

(56) References Cited

U.S. PATENT DOCUMENTS

| | | | | |
|---|---|---|---|---|
| 4,703,811 A * | 11/1987 | Lam | ..... | 173/28 |
| 5,310,014 A | 5/1994 | Mueller | | |
| 6,615,932 B2 * | 9/2003 | Huhdanmaki et al. | ..... | 175/52 |

FOREIGN PATENT DOCUMENTS

| | | | | |
|---|---|---|---|---|
| EP | 0391873 | 10/1990 | | |
| GB | 1221198 | * 2/1971 | ..... | E21B 3/00 |
| WO | WO/0061907 | 10/2000 | | |

* cited by examiner

*Primary Examiner* — Frederick L Lagman
(74) *Attorney, Agent, or Firm* — Mark P. Stone

(57) ABSTRACT

The present invention relates to a method for installing a pipe (313) when drilling a first hole with the aid of a rock drilling apparatus (100), wherein a tool (309) which can be connected to a drilling machine (306) via one or more drill rods (308) is used in said drilling, which method comprises—drilling a first part of said first hole,—installing a pipe (313) in at least a part or said first drilled part of said first hole, wherein the method further comprises:—installing said pipe (313) in said first hole while drilling of said first part of said first hole is in progress.—pulling said drill rod (308) out of said first hole before finishing drilling of said first hole to the desired, compared with said first part, deeper depth. The invention also relates to a system and to a rock drilling apparatus.

28 Claims, 7 Drawing Sheets

METHOD, SYSTEM AND ROCK DRILLING APPARATUS FOR INSTALLING A PIPE IN DRILLED HOLES IN ROCK DRILLING

FIELD OF THE INVENTION

The present invention relates to methods and systems for use in drilling, and in particular to a method for installing pipes in drilled holes in rock drilling. The invention also relates to a system and a rock drilling apparatus.

BACKGROUND OF THE INVENTION

Rock drilling apparatuses can be used within a number of fields of application. For example, rock drilling apparatuses can be used in tunnel driving, underground mining and rock reinforcement, in which the drilling, for example, can constitute drilling of blasting holes, injection holes, holes for the insertion of rock bolts, etc.

Depending on the type of field of application and/or type of drilling, drilling can take place under widely varying types of conditions, in which different drilling conditions typically pose different types of problems. In underground mining, for example, rock can be mined in different drilling directions, such as upwards, downwards and/or horizontally, in which drilling in the respective different directions can give rise to different types of problems. For example, the working height, i.e. the distance between the roof and floor of the mine, can be limited, with associated problems when drilling upwards or downwards.

In the case of downwardly directed drilling, further problems often arise. In the mining of an ore body or in tunnel driving, for example, a number of holes are usually drilled within a limited area, after which, when drilling of all the holes within the desired area has been completed, the holes are loaded with explosives for subsequent mining.

In the course of the drilling, drilling residues, so called drill cuttings, are formed and these drill cuttings are evacuated from the hole while drilling is in progress. This is usually carried out with the aid of a flushing medium, such as, for example, compressed air, flush air, which is led through a channel in the drill string for discharge through flush air holes in the bit so as thereafter to take the drilling residues with it on its way up out of the hole. In underground drilling, the flushing medium is usual constituted to a certain degree by a liquid such as, for example, water, for binding the drill cuttings and reducing dust formation.

When a number of holes are drilled close together in a downwardly directed manner, the problem arises, however, that the drill cuttings which are formed in the drilling of a hole are at risk of running down into already drilled holes in the vicinity of the hole which is currently being drilled, which leads to subsequent work with cleaning of already drilled holes. According to the above, moreover, a flushing medium at least partially consisting of liquid is usually used in underground drilling, which means that the drill cuttings form a clay paste, which after a number of drilled holes can cover the whole of the drilled surface, with the result that drilled holes, apart from being awkward to clean from drilling residues, can also be difficult to find.

For this reason, a first part of the hole is usually drilled first, after which the drill string, consisting of one or more drill rods, is pulled out of the hole and a pipe is inserted into the upper part of the hole before the hole is finish-drilled to the desired depth. This pipe insertion is laborious, however, and often requires the hole to be cleaned from cuttings before the pipe is inserted. Furthermore, once the pipe is in place, surrounding holes must be filled so that the pipe stands firm. During filling around the pipe, it is also easy for the angle of the pipe to be altered. Furthermore, it can be difficult to get the pipe down, in which case a feed device, for example, can be used as a power source to press down the pipe, with the risk of damages both to the pipe and to the feed device.

There is thus a need for an improved drilling method, primarily for use in, but not limited to, downwardly directed drilling underground.

SUMMARY OF THE INVENTION

It is an object of the present invention to provide an improved method far use in rock drilling, which method solves the above problems.

The present invention relates to a method for installing a pipe when drilling a first hole with the aid of a rock drilling apparatus, wherein a tool which can be connected to a drilling machine via one or more drill rods is used in said drilling, which method comprises:

drilling a first part of said first hole, installing a pipe in at least a part of said first drilled part of said first hole, wherein the method further comprises:

installing said pipe in said first hole while drilling of said first part of said first hole is in progress, wherein the method further comprises, when said first pipe has been installed in said first part of said first hole:

pulling said drill rod out of said first hole before finishing drilling of said first hole to the desired, compared with said first part, deeper depth.

The present invention thus relates to a method for installing a pipe when drilling a hole, in which the pipe is guided down into the hole while drilling is in progress. By virtue of the fact that, according to the present invention, the pipe is guided down into the hole while drilling is in progress, a significantly more secure installation of the pipe is obtained, since the pipe can automatically be guided down into the hole during the drilling, which means that the operator of the rock drilling apparatus does not need to leave the control station as much as previously, with the security which this usually brings in the form of, for example, overhead shelter. For example, according to the prior art, the operator of the rock drilling apparatus must leave the control station in order to manually guide the pipe down into the drill hole. According to the present invention, the inventive method is thus used in drilling the first part of a hole. Usually the drilled material is softest at the start of the hole, for example due to the fact that the surrounds of the drill hole are filled with drilling residues from previously drilled holes and/or blast stone according to the above. When said first part has been drilled, said drill rod can be pulled out of said first hole in order to change drill rod and/or tool before finishing drilling of said first hole to the desired depth.

In particular, the present invention is applicable in what here is denoted "collar pipe" installation, in which only the first part of the hole is provided with a pipe. In the case of, for example, holes which are drilled for subsequent blasting, it may be desirable for the walls of the hole to be constituted by rock for better blast effect, so that lining of the entire length of the pipe is not desirable.

In addition, the manual method for pipe installation according to the prior art is "dirty", since this often takes place in a "slurry" consisting of drilling residues, blast stone, etc., so that the present invention thus has the advantage that the number of "dirty" elements for the operator of the rock drilling apparatus can be reduced.

The present invention also has the advantage that installation of the pipe while drilling is in progress, which can take place automatically, brings time savings, and, since the pipe is guided down while drilling is in progress and the hole thereby is continuously cleared of drill cuttings, cleaning of a hole by hand or by means of another tool after drilling can be avoided according to the present invention. Likewise, since the pipe is guided down into the hole while drilling is in progress, drill cuttings will automatically fill up empty space around the pipe, so that, when the pipe has been guided down to the desired depth, the pipe will already have been wedged in place and be firmly anchored without the need for involvement of the operator of the rock drilling apparatus.

Moreover, in manual pipe installation, the pipe often gets loose, whereupon flushing medium flows around the pipe instead of in the pipe and creates paths for drill cuttings to run back down into the hole, whereby the purpose of the pipe is diminished. In such cases, the operator of the rock drilling apparatus must usually move back to the unprotected environment by the hole in order to attempt to seal the leak in a suitable manner or install the pipe all over again.

According to one embodiment of the present invention, a driving means is used to help guiding the pipe down into the hole while drilling is in progress. For example, the drill rod can be provided with a pusher means for pushing the pipe into the drilled hole as drilling progresses. This has the advantage that the pipe is not at risk of getting stuck on the way down into the hole due to obstacles, for example in the form of drilling residues. With the aid of the pusher means, it is possible to ensure that the pipe always reaches the desired position. The pusher means also has the advantage that insertion of the pipe when drilling obliquely downwards or in the lateral direction is simplified.

Instead of a pusher means, another type of driving means can be used. This driving means can be constituted, for example, by a flange disposed on the drill rod, or a flange portion or the like which engages with one or more lugs or the like configured in the pipe. Regardless of whether a pusher means or another type of driving means is used, it should be ensured, however, that sufficient passages are present to allow the cuttings which are flushed out of the hole to pass on.

According to a preferred embodiment of the present invention, a shorter drill rod than in normal so-called production drilling is used when drilling with simultaneous pipe insertion. This has the advantage that the drilling machine with drill rod and tool (bit) can be backed up as far as possible on, for example, the usually occurring feed device, such as a feed beam, whereby a pipe for installation can be guided into position in front of the drill rod so as to be taken up by this and brought along during the drilling. When drilling of the first part of the hole, and thus also the pipe installation, has been completed, the drill rod can be pulled up out of the hole, whereby the drill rod and/or drill bit can be exchanged for, for example, a longer drill rod and/or drill bit of smaller diameter (and/or without reamer part) before finishing drilling of the hole to the desired depth.

According to one exemplary embodiment of the present invention, the feed beam, at the end facing towards the material to be drilled, is provided with a pipe support. This has the advantage that the risk of the direction of the pipe, and also the drilling direction, getting wrong during drilling can be reduced.

According to one embodiment of the present invention, a positioning means, for example a pivot means such as an arm, is used to bring the pipe into position for insertion during drilling. This has the advantage that the pipe can be prepared for positioning, in a simple manner, so as then to be brought quickly into the desired position by means of manual or automatic maneuvering of the pivot means.

According to one embodiment of the present invention, a (for example pivotable) pipe magazine with space for a plurality of pipes is used, wherein said pipe magazine can be moved (for example pivoted) into a position such that a pipe, for example a desired pipe in the pipe magazine, is placed in the desired drilling position, whereby, when the desired pipe has been moved into the desired position, said pipe magazine can be moved aside during drilling so as to be out of the way during the actual drilling procedure.

According to one embodiment of the present invention, the first part of a plurality of holes is drilled, where a pipe is being installed during drilling of the respective first part of said plurality of holes. When the first part has then been drilled for said plurality of holes, drilling of said plurality of holes to the desired, compared with said first part, deeper depth is finished. In the case, for example, of a pipe magazine according to the above, the first part can be drilled for a number of holes corresponding to the number of pipes which can be handled by the pipe magazine. Alternatively, the first part of a lesser number of holes, or the first part of an even larger number of holes, is drilled, in which case the pipe magazine, for example, can be refilled with pipes before finishing drilling of the holes. The refilling of pipes can be carried out, for example, at another, safer place compared with the drilling location.

By drilling the first part of a plurality of holes one after another, with associated pipe insertion, before, for example, drill rod and/or bit are, where necessary, exchanged for another type of drill rod length/bit for finishing drilling of the started holes, a very efficient drilling method with minimal idle time is obtained.

Further characteristics of the present invention and advantages thereof will emerge from the following detailed description of illustrative embodiments and the appended drawings.

DETAILED DESCRIPTION OF AN ILLUSTRATIVE EMBODIMENT

Figure 1:
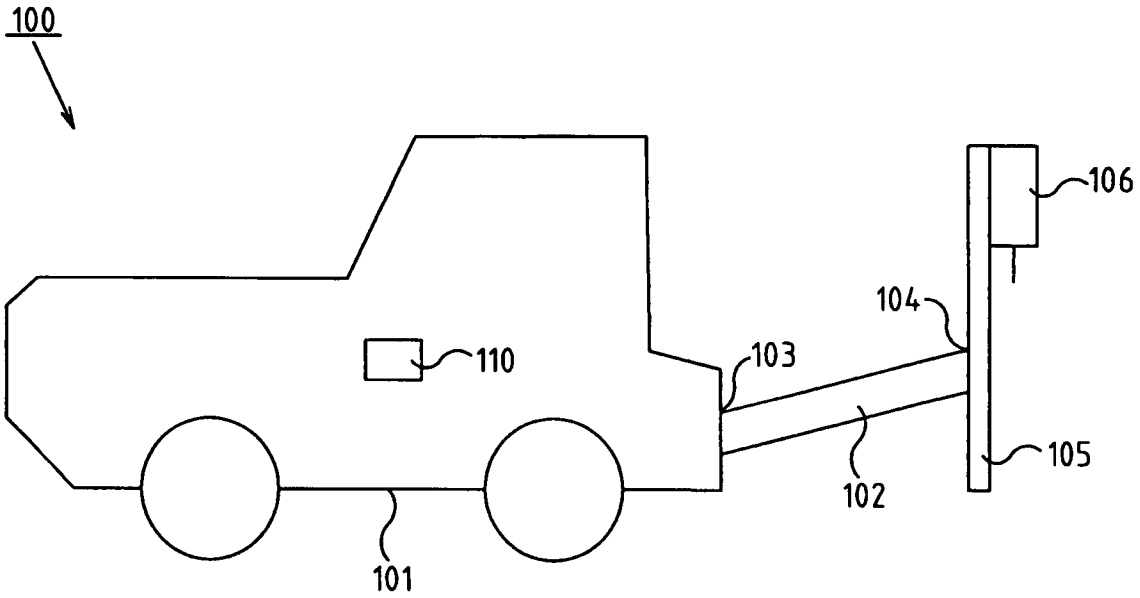
FIG. 1 shows a rock drilling apparatus in which the present invention can advantageously be utilised.

FIG. 1 shows a rock drilling apparatus according to an illustrative embodiment of the present invention and with which an inventive pipe installation will be described.

FIG. 1 shows the rock drilling apparatus in the form of a rock drilling rig 100 for tunnel driving, ore mining or installation of rock reinforcement bolts in, for example, tunnel driving or mining. The rock drilling rig 100 comprises a boom 102, one end 103 of which is fastened to a carrier 101, and on the other end 104 of which is disposed a feeder 105 supporting a drilling machine 106. The drilling machine 106 is displaceable along the feeder 105.

The boom 102 (only one boom is shown in the figure, but the rock drilling rig can also comprise two or more booms) is articulately fixed to the carrier 101 by one or more joint members. These joint members can be constituted, for example, by hydraulic cylinders and enable raising, lowering and/or lateral displacement of the boom. Correspondingly, the feeder 105 is fixed by joint members to that end 104 of the boom 102 which is facing away from the carrier, so as to enable adjustment of the feeder, and thus the drilling machine 106, in the desired drilling direction.

As has been stated above, it is in certain situations desirable that, in drilling, the first part of the drilled hole is provided (i.e. clad/lined) with a pipe to prevent drilling residues (so-called drill cuttings) and other material, for example stones, rock remnants, etc., from falling down into already drilled holes, in particular in the case of downwardly directed holes.

Figure 2:
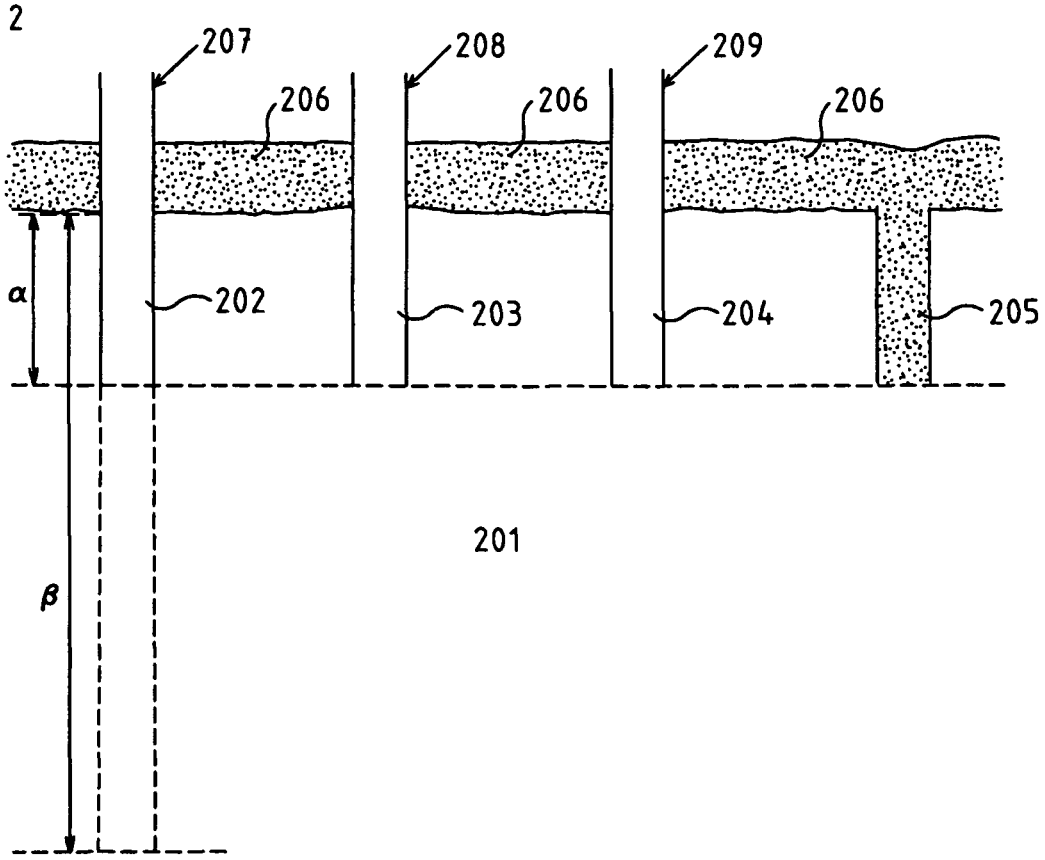
FIG. 2 shows an example of a rock drilling principle in underground ore mining.

An example of a rock drilling principle in underground ore mining is shown in FIG. 2. The rock from which ore is extracted is denoted by 201 and, as can be seen from the figure, four started holes 202, 203, 204 and 205 are present. As is shown, the four holes are only drilled to a level $\alpha$, which can be constituted by a measure in the order of magnitude of 0.5-2 meters.

Before drilled holes are loaded with explosive for breaking the rock, the holes are usually drilled, however, to a significantly deeper depth, such as to a level $\beta$, which can be 5, 10, 15 or 20 m or more. Drilling of the holes shown in FIG. 2 is thus not finished. FIG. 2 also shows the "mud" 206 of drilling residues mixed with flushing medium and blast stone, etc., which is usually formed in drilling/mining of the rock. This mud can have varying thickness and can constitute, for example, a 0.1-0.5 m thick layer which must first be passed before solid rock is encountered. If drilling to the desired hole depth takes place directly, it is therefore likely, as indicated for hole 205, that drilling residues will run down into the drilled hole and prevent an effective/desired subsequent loading of the hole with explosive without cleaning of the hole.

For this reason, the holes are usually first drilled to the depth $\alpha$, after which pipes 207, 208, 209, such as plastics pipes, aluminium pipes, sheet-metal pipes or the like, are installed in the started hole in such a way that the upper end of the pipe sticks up through the mud so as thus to prevent drilling residues from running down into the drilled hole.

As stated above, the installation of pipes 207, 208, 209 is carried out, however, in such a way that the hole is first drilled to the depth $\alpha$, after which the drill rod is pulled up out of the hole for subsequent manual pipe installation by the operator of the drilling rig. This operation, apart from being dirty, exposes the operator of the drilling rig to unnecessary risk when the operator has to leave the comparatively protected environment in the operator's cab of the rock drilling rig to insert a pipe into a drilled hole, with the further problems that this brings according to the above.

Figure 3B:
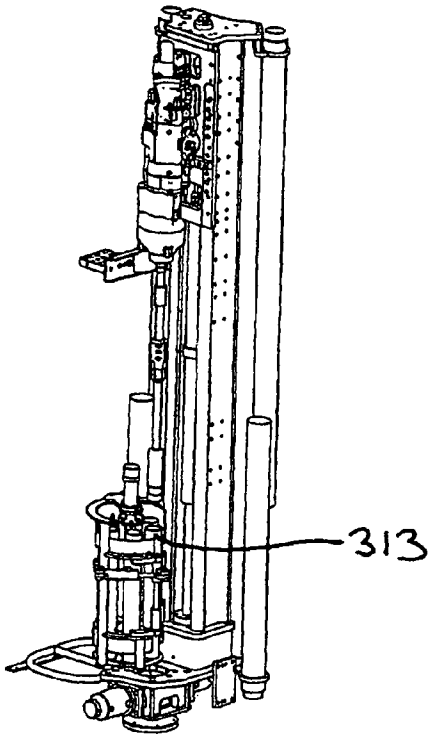
FIG. 3B-D show the drill rod and the pipe magazine position for three different instants for the feed beam shown in FIG. 3A.
Figure 3A:
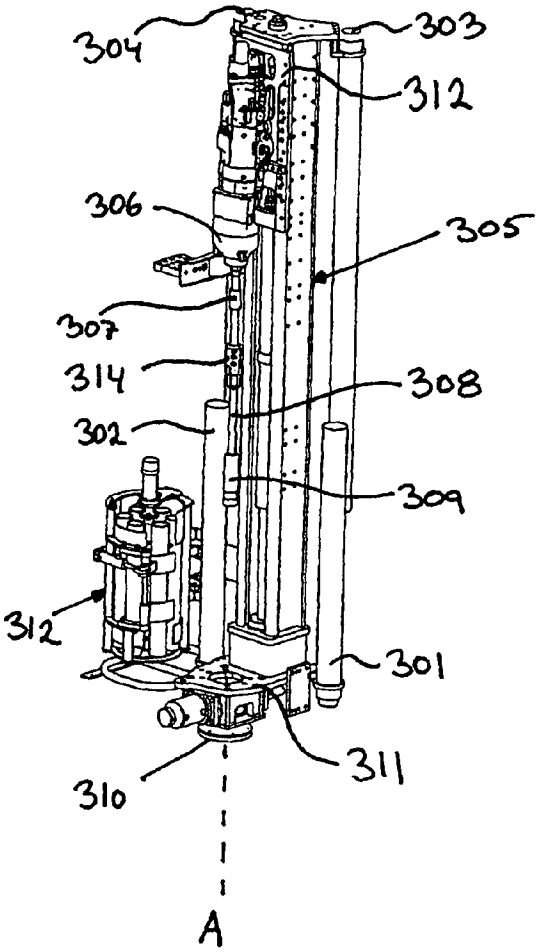
FIG. 3A shows the feed beam for the rock drilling rig shown in FIG. 1, in greater detail.

According to the present invention, an improved pipe installation is provided that reduces or wholly eliminates the previously known method for installing pipes in drill holes. This is achieved by virtue of the fact that the pipe, according to the present invention, is guided down into the hole while drilling is in progress and preferably with the aid of the drill rod. In FIG. 3A, the feed beam for the rock drilling rig 100 shown in FIG. 1 is shown in greater detail. For the sake of simplicity, the fastening of the feed beam to the boom 102 is not shown. Feed beam and drilling machine can be constituted by a conventional feed beam/drilling machine with additions as set out below. The drilling machine 306 (106) is attached to a slide 312, displaceable along the feed beam, in order thus to enable displacement of the drilling machine 306 in a drilling direction A. The feed beam further comprises drill supports 301, 302, 303, 304, for example consisting of hydraulic cylinders which can be used to fix the feed beam to the floor/roof of the mine in order to ensure good support during drilling such that the desired feed force can be generated. The connection of the drilling machine to the drill rod 308 can be constituted by any chosen conventional connection, such as a threaded joint, denoted by 307, and the drill rod is terminated with a drill bit 309. As can be seen in the embodiment shown, a relatively short drill rod 308 is used. In drilling, as long a drill rod as possible is normally used, for example a drill rod which, when the slide is reversed as far as possible on the feed beam, i.e. positioned as close as possible to that end of the feed beam facing away from the hole during drilling, extends to or even past a drill support/pipe support 310 in order to enable the greatest possible drilling length before a new drill rod must be supplied to the drill string. In the following description only one drill rod is used, so that the term drill rod, rather than indeed drill string, is used. It will be appreciated, however, that the below-illustrated drill rod can be constituted by a drill string consisting of two or more drill rods.

Figure 5:
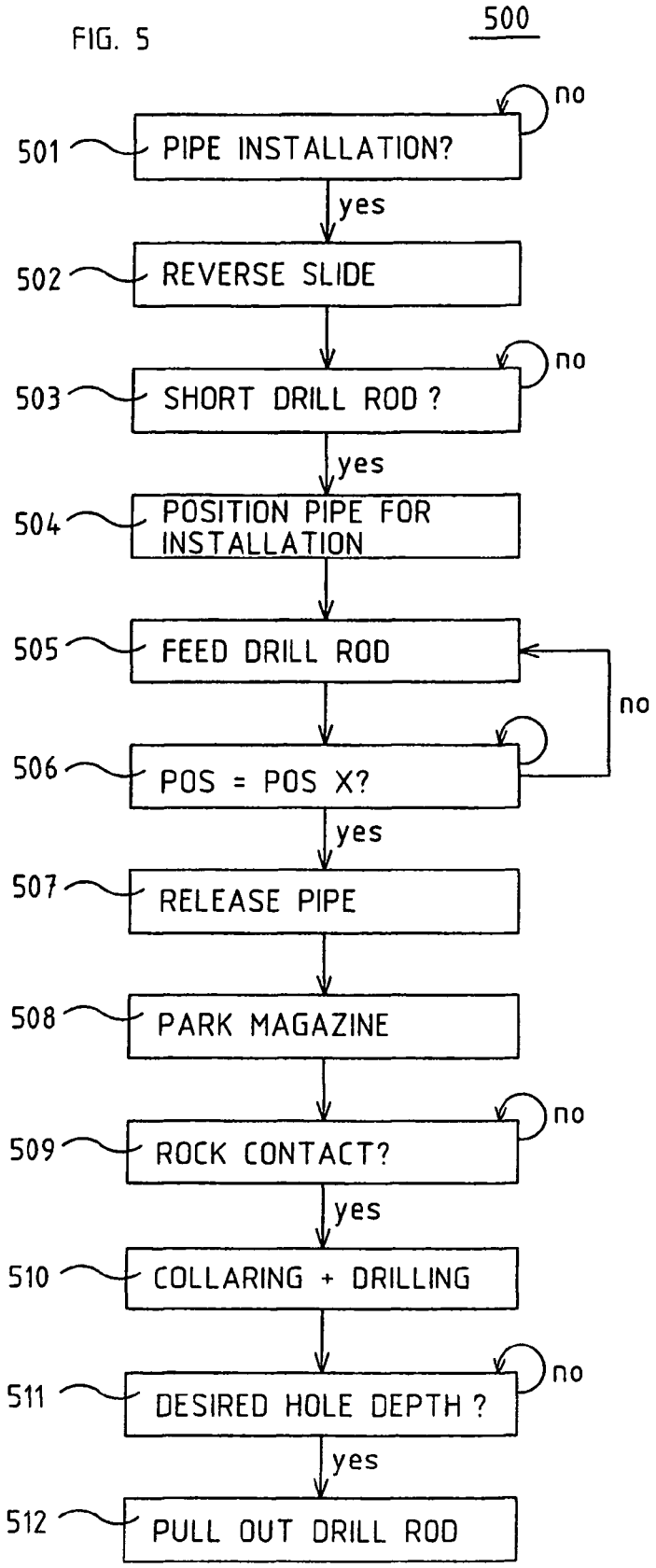
FIG. 5 shows an exemplary method for pipe installation with the device shown in FIG. 3A.

According to the shown exemplary embodiment of the present invention, a drill rod is used which is so short that a pipe can be introduced between the drill rod 308 (the drill bit 309) and the end portion 311 of the feed beam. An exemplary method 500 for pipe installation with the device shown in FIG. 3A is shown in FIG. 5 and is carried out as follows. The method can be conducted, for example, by a control unit 110 disposed on the rock drilling rig 100, and in step 501 it is determined whether pipe installation is to be carried out. If this is the case, the slide 312, with the drilling machine 306, is moved as far back as possible on the feed beam 305 in step 502, unless already carried out, so as to free the greatest possible space in front of the drill bit 309. It is further ensured, step 503, that the, according to the above, relatively short drill rod 308 has been fitted. This can be realized, for example, with the aid of suitable sensor signals, or by the operator of the rock drilling rig indicating to the control system that this is the case, for example by suitable inputting via suitable interface with the control system. The system may also already be aware that fitting of a short drill rod 308 has already been carried out earlier, for example for drilling of a preceding hole. When the slide 312 has been reversed into the desired position, the pipe to be installed is positioned in front of the drill bit 309, step 504. In the exemplary embodiment shown, a pivotable, for example with the aid of a swivel arm, pipe magazine 312 is used to position the desired pipe in position for installation.

Figure 4:
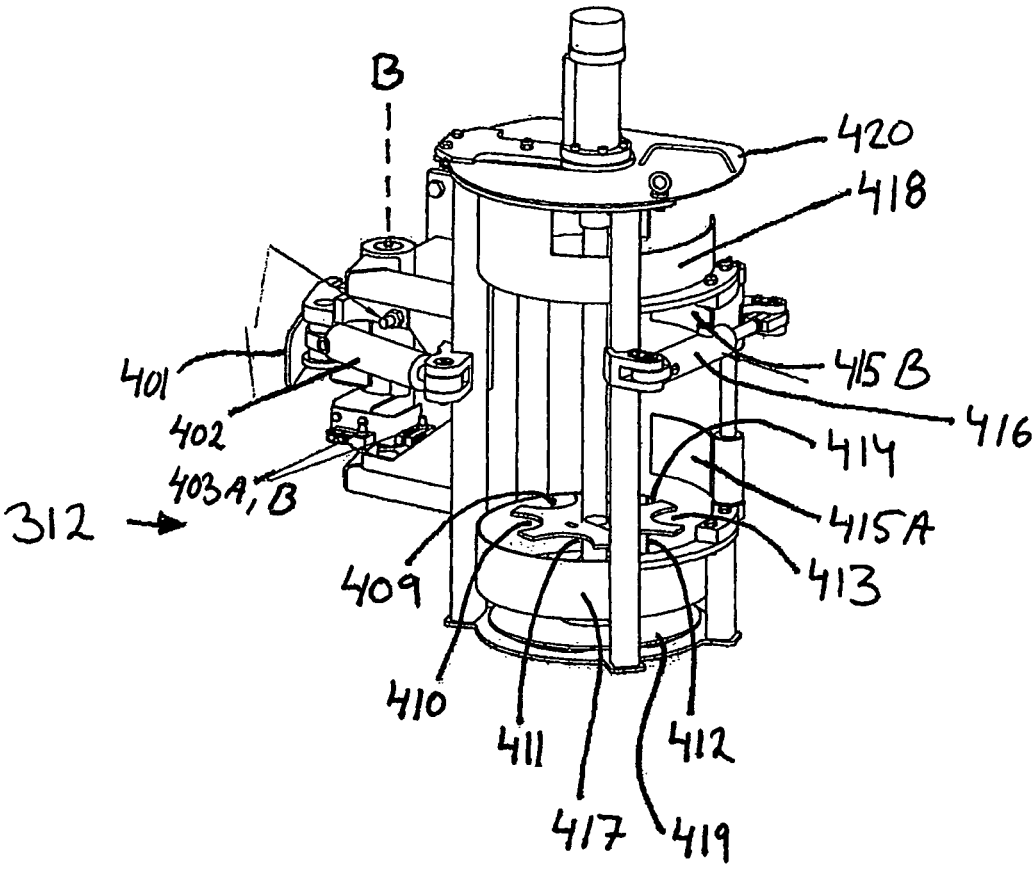
FIG. 4 shows an exemplary embodiment of a pipe magazine, in greater detail.

The pipe magazine 312 is shown in greater detail in FIG. 4. The magazine 312 is fastened to the feed beam 305 by a mounting plate 401. In addition, the magazine 312 is arranged pivotably about an axis B. The magazine 312 can be pivoted about the axis B with the aid of a hydraulic cylinder 402. With the aid of the hydraulic cylinder 402, the pipe magazine 312 can be pivoted towards the drilling centre in order to position the centre line of a pipe 313 (see FIG. 3B) substantially in the centre line A of the drill rod 308 (see FIG. 3A). In the example shown, the pipe magazine comprises six pipe positions 409-414, and when the pipe magazine 312 has been swung in towards the drilling centre, the pipe, at position 414 (the pipe is not shown in FIG. 4), will be in the desired position. This is shown in FIG. 3B, in which the pipe magazine 312 has been turned in such that the pipe 313 is in the desired position.

In order to ensure that the pipe magazine has reached the desired position and, for example, to indicate this to the control system of the drilling rig, position transmitters, such as inductive transmitters 403 A, B, can be used. For example, the transmitter 403A can be used to indicate that a parking position has been reached, i.e. that the magazine has been swung aside so as to be out of the way during the actual drilling process, whilst the transmitter 403B can be used to indicate that the magazine has been pivoted towards the drilling centre into the desired position for fitting of a pipe, or vice versa.

When the magazine 312 has been swung in to the drilling centre and a pipe has thus been placed with the centre line substantially in the centre line of the drilling direction, the method continues to step 505 in FIG. 5. In step 505, the slide 302, and thus the drilling machine 306 and the drill rod 308, is advanced, preferably at a slow rate of advance, towards the pipe 313. Preferably, a slow rotation speed is also imparted to the drill rod for rotation of the drill rod in a direction directed oppositely to the rotational direction during drilling, for the reason set out below.

Figure 3D:
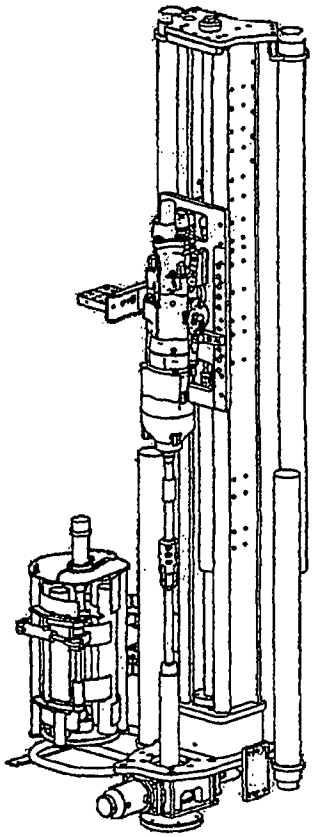
Figure 3C:
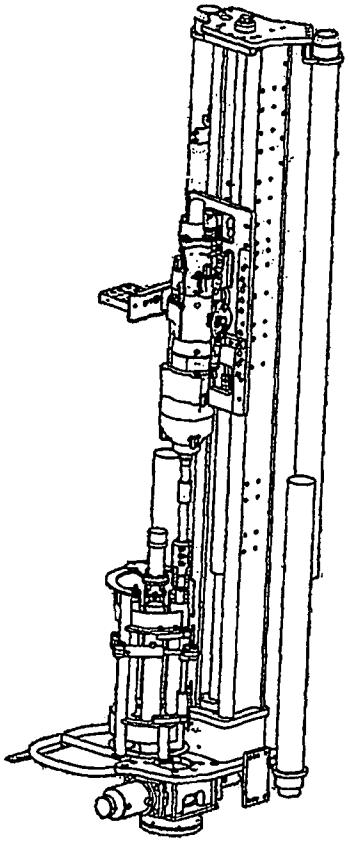

When the drill rod (the drill bit) has been advanced to the desired position Pos=Pos x, step 506, (the position in FIG. 3C), constituting a position in which the drill bit has been advanced a desired length into the pipe 313, the pipe 313 is released from the magazine 312, step 507 (FIG. 3D). In the present example, this is achieved by the opening of one or more hatches 415A, 415B disposed on the casing of the magazine. The hatches 415A,B, together with upper and lower end plates 420, 419, hold pipes in the position 414 in place and prevent pipes in the position 414 from falling out (for other positions 409-413, the pipes are held in place with the aid of casing surfaces 417, 418). Opening of the hatches 415A,B is carried out with the aid of a hydraulic cylinder 416. When the hatches 415A,B have been opened, the magazine 312 is pivoted with the aid of the hydraulic cylinder 402 back into the parking position, step 508. This means that when the pipe 313 is released from the end plate 419 of the magazine, the pipe 313 will "drop down" against the pipe support 310, see FIG. 3D.

Figure 6:
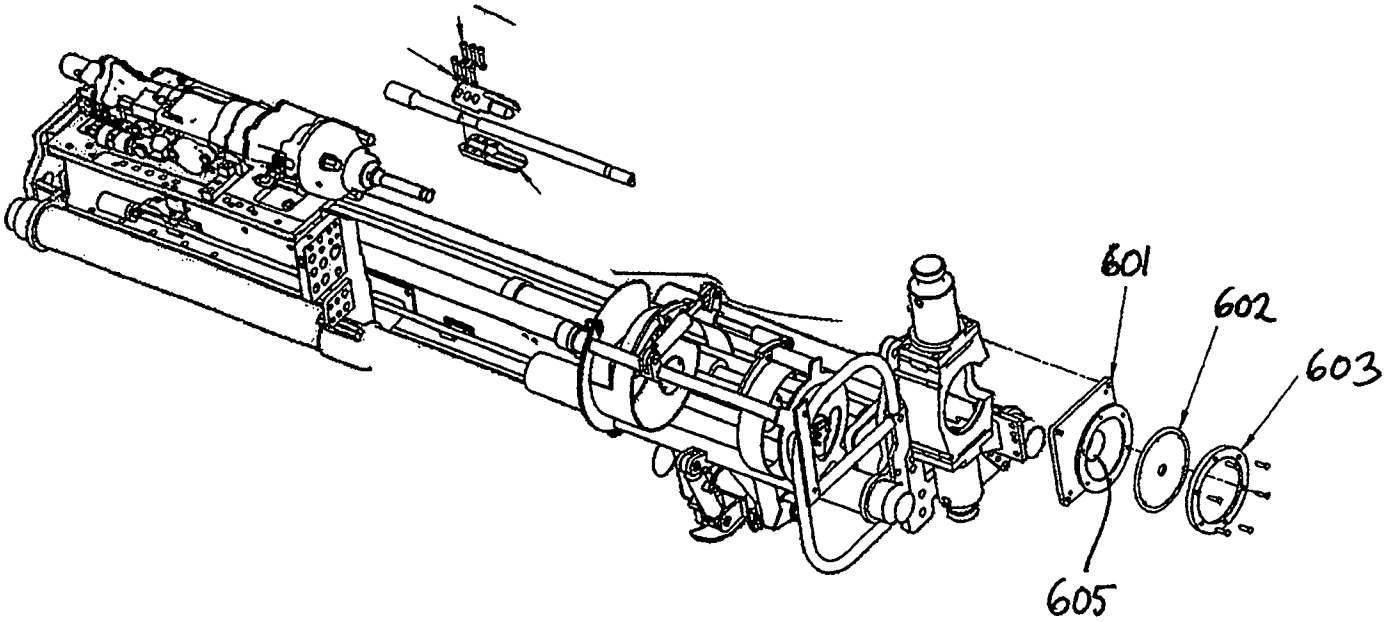
FIG. 6 shows an exemplary embodiment of a pipe support for the rock drilling rig shown in FIG. 1.

As can be seen in FIG. 3D, the drill rod (the drill bit) has been advanced so far that, even when the magazine 312 has been swung aside and the pipe has dropped down against the pipe support 310, it is still partially inserted in the pipe. The pipe support 310 is shown in greater detail in FIG. 6 and substantially consists of a plate 601 with a hole 605. To the plate 601, a diaphragm 602, such as a rubber diaphragm, is fastened by means of a screw joint 603. The diaphragm 602 ensures that the pipe does not pass through the drill support 310 when the magazine 312 is guided into the parking position, but instead is caught/slowed down by the diaphragm 602. The diaphragm 602 further has the advantage of sealing the diaphragm 602 with respect to the pipe 313 while drilling is in progress.

Returning to FIG. 5, the method then continues to step 509, in which the slide is fed forwards until the drill bit 309 has passed through the pipe 313 and rock contact is attained.

In order to ensure that the pipe 313 accompanies the drill rod during drilling, a pusher means 314 disposed on the drill rod 308 is used in the shown embodiment. An example of a pusher means 314 is shown in greater detail in FIG. 7 and consists of two parts 314A, 314B joined together by means of a screw joint on the drill rod 308. In order to prevent mutual axial movement between the pusher means 314 and the drill rod 308, the drill rod in the present example is provided with a recess in the form of a turned cavity 315. The pusher means portions 314A, 314B have corresponding engagement portions for engaging with the recess 315 of the drill rod 308, in the shown embodiment consisting of a first part 316A having a recess such as a turned cavity with a radius corresponding to or exceeding the recess 315 of the drill rod 308, but smaller than the radius of the drill rod on respective sides of the recess 315, whilst a second part 316B has a recess such as a turned cavity corresponding to the radius of the drill rod 308 on respective sides of the recess 315, whereby it can thus be ensured that the pusher means 314 cannot be axially displaced relative to the drill rod 308.

As will be appreciated, the configuration of drill rod and pusher means can take many different forms. For example, the drill rod can be provided with, for example, a flange instead of a recess, whilst the pusher means comprises, for example, a corresponding recess. Likewise, the pusher means can constitute an integral part of the drill rod.

Figure 7:
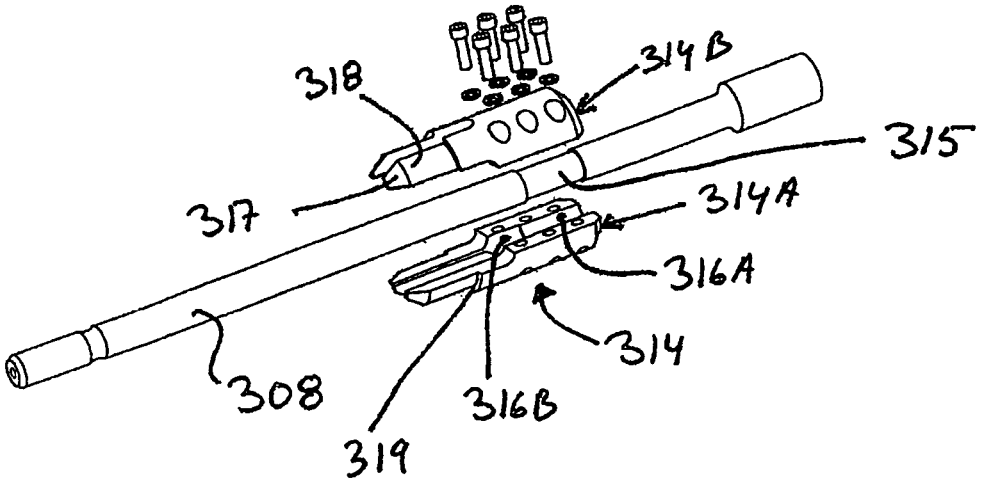
FIG. 7 shows an exemplary embodiment of a pusher means for ensuring that a pipe accompanies a drill rod in drilling.

The pusher means 314 shown in FIG. 7, at its end facing towards the pipe, is also provided with chamfers 317 so that a pipe-supporting portion 318 having an outer diameter substantially corresponding to the inner diameter of the pipe 313 will be guided into the pipe 313. The pipe-supporting portion 318 is terminated with an engagement means, in this example in the form of an edge 319 having a diameter exceeding the inner diameter of the pipe in order to prevent the pipe 313 from passing the edge 319. The edge 319 can thus apply a pushing force to the pipe 313 during operation.

When, in step 509, rock contact has then been attained, the feeder is reversed a suitable distance, for example one or two centimeters, in a conventional manner, before drilling, preferably firstly by conventional collaring/start drilling, is commenced in step 510.

During drilling, the pipe 313 will accompany the drill rod 308 down into the hole with the aid of gravitational force or, where this is not sufficient, installation of the pipe in the hole is ensured with the aid of the pusher means 314.

By means of collaring/full drilling, drilling to the desired depth then takes place, step 511. When drilling has been carried out to the desired depth, i.e. when the pipe 313 has been guided down to the desired depth, the drilling is discontinued and the drill rod with drill bit is guided up and out of the pipe 313, step 512, in order to start a new hole with pipe insertion, or alternatively to change drill rod and drill bit in order to finish the hole according to what has been described above in connection with FIG. 2.

In order for the drill bit to be able to be led up out of the pipe 313 without the installed pipe being jointly pulled up out of the hole, a drill bit having a centrifugal-force-controlled reamer part is used in the present example, which reamer part reams the hole to sufficient diameter to allow the pipe to be installed in the hole. When the desired depth has been reached, this reamer part can be "folded in" by rotating the drill rod in the opposite direction, whereby the drill rod can be led up through the pipe. This is also the reason for the drill rod being rotated in a direction opposite to the drilling direction during advancement to the pipe, as described in connection with FIG. 3C, since this rotation of the drill rod ensures that the reamer part has been folded in. For example, drill bits of the so-called ODEX type can be used, which drill bits are available from and sold by Atlas Copco, but other drill bits that allow the drill rod to be pulled up out of the hole may also be used.

The present invention thus provides a substantially improved method for installing pipes in drill holes while drilling is in progress. According to the above, the present invention is especially advantageous in underground drilling, especially in collar pipe installation, in which the pipe installation is especially complicated and connected with dangers for the operator of the drilling rig. Furthermore, the first part of a plurality of holes can thus be drilled one after another, with associated pipe insertion, before the drill rod and/or bit, where necessary, are exchanged for another type of drill rod length/bit for finishing drilling of the started holes. For example, the first part can be drilled for the number of holes which are to be drilled at any given stage, for example before new blasting is carried out, or the number of holes which are found to be suitable with regard to possibilities of moving the machine in relation to drilled (first parts of) holes before drilling of the holes is finished.

Moreover, the holes can be arranged to be drilled according to a predetermined drilling plan, in which the holes are drilled according to programmed coordinates. The control system can control, for example, which holes are to be drilled and, in one embodiment, also in which order. Positioning of the drilling machine in the desired direction/position according to defined coordinates for drilling of the desired hole can be either assisted by the control system, where the operator obtains feedback, for example via a display, on how the drilling machine is related in relation to the desired position, whereby the operator can use the feedback from the control system to position the drilling machine in the correct direction for drilling. Alternatively, the positioning can also be carried out fully automatically by the control system by means of suitable alignment means, such as a specifically designated part of the control system for the control of actuators, etc., for the desired positioning of the drilling machine.

The specific drilling plan thus means that the holes can be drilled with high precision at a predetermined position. For example, the control system can choose a certain set of holes which are to be drilled before the magazine must be filled again with new pipes. Even when drilling according to a drilling plan as set out above, the first part can thus be drilled for a plurality of holes, in which also new pipes can be fetched for drilling of a greater number of holes before drilling of the holes is finished. The control-system-controlled or assisted alignment of the drilling machine for subsequent finishing of the drilling also means that the finished hole will exhibit good conformity with the desired hole.

The invention claimed is:

1. Method for installing a first pipe (313) when drilling a first hole with the aid of a rock drilling apparatus (100), wherein a tool (309) connectable to a drilling machine (306) via one or more drill rods (308) is used in said drilling, which method comprises:

drilling a first part of said first hole, installing said first pipe (313) in at least a part of said first drilled part of said first hole, installing said first pipe (313) in said first hole while drilling of said first part of said first hole is in progress, wherein the method further comprises, when said first pipe (313) has been installed in said first part of said first hole:

pulling said drill rod, (308) out of said first hole before finishing drilling of said first hole to the desired, compared with said first part, deeper depth.

2. Method according to claim 1, further comprising pulling said drill rod (308) out of said first hole in order to change drill rod (308) and/or tool (309) before finishing drilling of said first hole to the desired, compared with said first part, deeper depth.

3. Method according to claim 1, further comprising, before drilling said first part of said first hole:

positioning said first pipe (313) in a first position with the aid of a positioning means, wherein in said first position at least the centre line for that end of said first pipe (313) which is facing away from the drilling direction corresponds substantially to the centre line of the drill rod.

4. Method according to claim 3, further comprising, after positioning of said first pipe (313):

advancing said drill rod (308), and holding on to said first pipe (313) until said drill rod (308) has bean advanced into a position in which said drill rod (308) has at least partially penetrated said first pipe (313).

5. Method according to claim 1, wherein, in said drilling of said first part of said first hole, a shorter drill rod (308) is used compared with a normal drill rod length for said rock drilling apparatus.

6. Method according to claim 1, wherein, in said drilling of said first part of said first hole, said pipe (313), for installation during said drilling, is positioned in front of said drill rod (308) for penetration by the latter.

7. Method according to claim 1, wherein said drilling machine (306) is arranged displaceably along a feed device (305), and wherein, in said drilling of said first part of said first hole, a drill rod (308) is used that has a length that allows said first pipe (313), with the aid of positioning means, to be introduced between said drill rod (308) and a drill support (310) disposed on said feed device (305) on the end facing away from the drilling machine (306).

8. Method according to claim 1, wherein a driving means (314) is used to ensure that said pipe (313) is transported during drilling and installed in said first hole while drilling is in progress.

9. Method according to claim 1, further comprising, in the advancement of the drill rod (308) for penetration of said first pipe (313):

imparting a rotation speed to said drill rod (308), wherein the rotational direction for said drill rod (308) constitutes a direction directed oppositely to the rotational direction during drilling.

10. Method according to claim 1, wherein said pipe installation is only carried out in said first part of said first hole, and wherein the method further comprises, when said first pipe (313) has been installed in said first part of said first hole:

drilling said first hole to a second depth which is at least double that of said first part.

11. Method according to claim 1, wherein said installation of said pipe (313) is carried out automatically by a control system (110) disposed in the rock drilling apparatus (100).

12. Method according to claim 1, further comprising:

drilling a first part of a plurality of holes, wherein a pipe is installed during drilling of the respective first part of said plurality of holes, and, when said first part has been drilled for said plurality of holes, finishing drilling of said plurality of holes to the desired, compared with said first part, deeper depth.

13. System for installing a pipe (313) when drilling a first hole with the aid of a rock drilling apparatus (100), wherein a tool (309) connectable to a drilling machine (306) via one or more drill rods (308) is used in said drilling, which system comprises:

means for drilling a first part of said first hole, means for installing a pipe (313) in at least a part of said first drilled part of said first hole, means for installing said pipe (313) in said first hole while drilling of said first part of said first hole is in progress, wherein the system further comprises: means for, when said first pipe (313) has been installed in said first part of said first hole:

pulling said drill rod (308) out of said first hole before finishing drilling of said first hole to the desired, compared with said first part, deeper depth.

14. System according to claim 13, wherein said system comprises means for pulling said drill rod (308) out of said first hole for a change of drill rod (308) and/or tool (309) before finishing drilling of said first hole to the desired, compared with said first part, deeper depth.

15. System according to claim 13, wherein the system further comprises a driving means (314) for ensuring that said pipe (313) is transported during drilling and installed in said first hole while drilling is in progress.

16. System according to claim 15, wherein said driving means is constituted by a pusher means (314).

17. System according to claim 16, wherein said pusher means (314), on its end facing towards the pipe (313), is provided with a pipe-supporting portion (318) intended for introduction into said pipe (313).

18. System according to claim 16, wherein said pusher means (314) comprises engagement means (319) for engaging with said drill rod in order to substantially prevent axial displacement of said pusher means (314) in relation to said drill rod (308).

19. System according to claim 13, wherein said system further comprises positioning means for positioning said first pipe (313) for installation with the aid of a rotary, pivotable and/or rotatable pipe magazine (312) with space for a plurality of pipes (313).

20. System according to claim 13, wherein said system further comprises a pipe magazine (312) with space for a plurality of pipes (313), wherein said pipe magazine (312) can be moved into a first position in which the desired pipe (313) in the pipe magazine (312) is placed in position for drilling, wherein, when the desired pipe (313) has been moved into said position, said pipe magazine (312) is moved to a second position when drilling.

21. System according to claim 13, wherein said pipe in constituted by a collar pipe (313).

22. System according to claim 13, wherein said system comprises control means for controlling drilling of said holes according to a first drilling plan, wherein said holes are drilled according to programmed coordinates.

23. System according to claim 13, wherein said system comprises alignment means for automatically positioning said drilling machine in drilling of said holes.

24. System according to claim 13, wherein;

said system is further designed to drill a first part of a plurality of holes, wherein a pipe is installed during drilling of the respective first part of said plurality of holes, and, when said first part has been drilled for said plurality of holes, finishing drilling of said plurality of holes to the desired, compared with said first part, deeper depth.

25. System according to claim 13, wherein said drilling machine (306) is arranged displaceably along a feed device (305).

26. Rock drilling apparatus (100), wherein said rock drilling apparatus comprises a system according to claim 13.

27. Rock drilling apparatus according to claim 26, wherein said rock drilling apparatus is constituted by a rock drilling rig comprising a carrier (101) and a feed device (305), connected to the carrier, for supporting said drilling machine (306).

28. Rock drilling apparatus according to claim 27, wherein the feed device (305), on its end facing in the drilling direction, is provided with a pipe support (310).

* * * * *